United States Patent [19]

Nelson et al.

[11] 4,439,139

[45] Mar. 27, 1984

[54] FURNACE STACK DAMPER CONTROL APPARATUS

[75] Inventors: Lorne W. Nelson, Bloomington; Ralph H. Torborg, Minnetonka, both of Minn.

[73] Assignee: Honeywell Inc., Minneapolis, Minn.

[21] Appl. No.: 352,814

[22] Filed: Feb. 26, 1982

[51] Int. Cl.[3] ..... F23N 3/00

[52] U.S. Cl. ..... 431/20; 236/1 G

[58] Field of Search ..... 431/20; 236/1 G, 45, 236/46 R; 126/285 B; 165/12; 307/65, 66

[56] References Cited

U.S. PATENT DOCUMENTS

| | | | |
|---|---|---|---|
| 2,241,590 | 5/1941 | Field, Jr. | 236/1 F |
| 2,396,777 | 3/1946 | Edwards | 110/147 |
| 2,692,640 | 10/1954 | Field | 431/20 |
| 3,273,625 | 9/1966 | Holtzman et al. | 431/20 |
| 3,725,644 | 4/1973 | Bailey | 219/444 |
| 3,871,443 | 3/1975 | Jones | 236/1 G |
| 4,039,123 | 8/1977 | Frankel | 236/1 G |
| 4,079,884 | 3/1978 | Sherman | 236/1 G |
| 4,087,045 | 5/1978 | Matthews | 236/1 G |
| 4,102,629 | 7/1978 | Feinberg | 431/20 |
| 4,108,369 | 8/1978 | Prikkel | 236/1 G |
| 4,138,060 | 2/1979 | Iacono | 236/1 G |
| 4,157,785 | 7/1979 | Freliech | 236/1 G |
| 4,185,769 | 1/1980 | Nezworski | 236/1 G |
| 4,205,783 | 6/1980 | Dietsche et al. | 236/1 G |
| 4,239,477 | 12/1980 | Hayes | 431/20 |
| 4,249,883 | 2/1981 | Woolfolk | 431/20 |
| 4,251,024 | 2/1981 | Feinberg | 236/1 G |
| 4,264,033 | 4/1981 | Kutzner et al. | 236/1 G |

OTHER PUBLICATIONS

M436A and M836A Damper Motor Instruction Sheet, Form No. 60-2119-3, Rev. 10-75 (0.025) by Honeywell, Inc., Minneapolis, Minn.

T8100A Microelectronic Chronotherm Fuel Saver Thermostat Instruction Sheet, Form No. 60-2535, Rev. 5-81 by Honeywell, Inc., Minneapolis, Minn.

T8200A Microelectronic Chronotherm Fuel Saver Thermostat Instruction Sheet, Form No. 60-2536, Rev. 5-81 by Honeywell, Inc., Minneapolis, Minn.

*Primary Examiner*—Lee E. Barrett

*Attorney, Agent, or Firm*—Clyde C. Blinn

[57] ABSTRACT

A furnace stack damper control apparatus has a motor for connection to a stack damper to open the damper upon a call for heat by a space thermostat. The motor is driven in a closed direction by electrical energization and in an open direction by a spring return. A relay having two normally open switches and a normally closed switch is energized when a space thermostat calls for heat. The normally closed switch then opens to allow the damper motor to open the damper by the spring return. The motor has an end switch having a normally open and a normally closed circuit. The normally open circuit is used with one of the normally open switches of the relay to energize a gas valve when the damper is open. The normally closed end switch is used to provide the energization circuit for the relay by the space thermostat and the relay is maintained energized when the damper is open by the other normally open switch of the relay connected in parallel to the normally closed end switch. The circuit provides for additional safety in that normal operation of the gas valve control apparatus does not take place if the normally open or normally closed end switches stick in either position.

4 Claims, 3 Drawing Figures

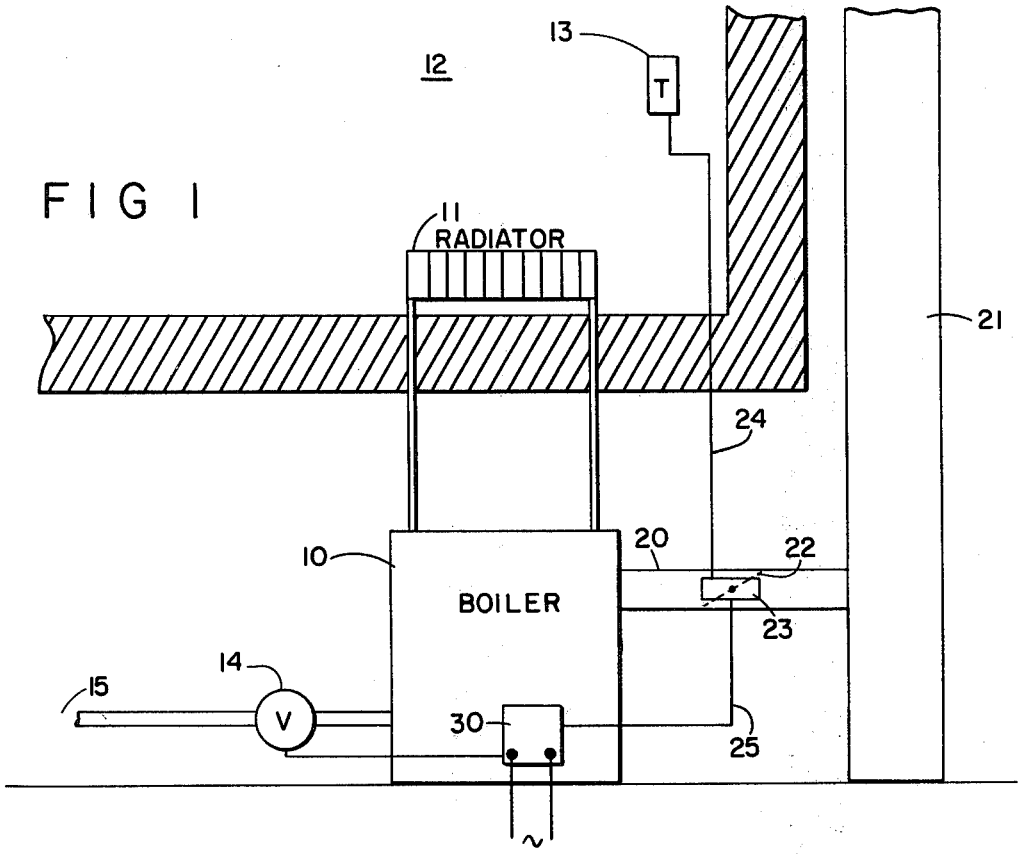
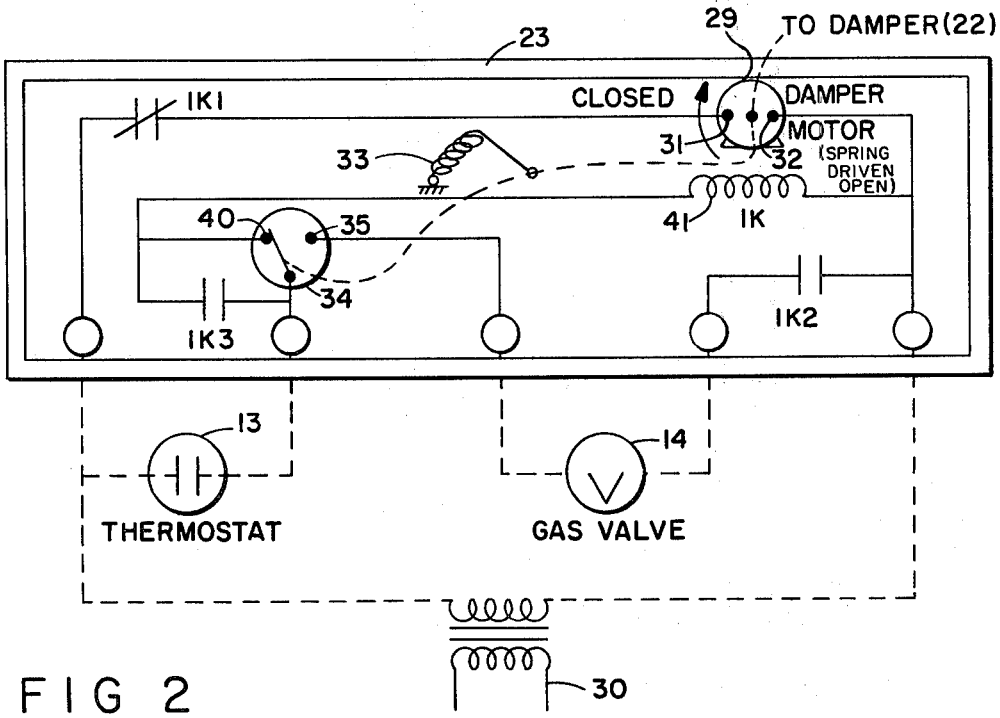
FIG 2

FURNACE STACK DAMPER CONTROL APPARATUS

BACKGROUND OF THE INVENTION

With the advent of high energy costs, especially fuel for fuel burning furnaces for home heating applications, the loss of energy through the exhaust stack during the non-heating cycle of the furnace has been recognized as a major energy loss. While furnace stack damper control apparatus in many forms has been known for some time, the safety aspect of such apparatus has somewhat deterred past use of such apparatus. While many different types of control circuits for such apparatus are known, there has always been a need for a more reliable and safe circuit as the failure of such a stack damper control apparatus on a furnace can result in the confinement of fuel combustion products in a house resulting in a hazardous condition to the occupants.

SUMMARY OF THE PRESENT INVENTION

The present invention is concerned with a furnace stack damper control apparatus having a spring return motor with a normally closed and normally open end switch which is used in one position to provide the energization circuit for a gas valve and in the other position to provide an energization circuit for a relay which controls the de-energization of the spring return motor. By means of the switches operated by the relay, should the end switch stick or fail in one position or the other, the circuit becomes inoperative and a safer condition of such a furnace stack damper control apparatus is provided.

BRIEF DESCRIPTION OF THE DRAWING

FIG. 1 shows a typical furnace with the application of a stack damper control apparatus;

FIG. 2 is one embodiment of the furnace stack damper control apparatus of the present invention.

DESCRIPTION OF THE PRESENT INVENTION

Figure 3:
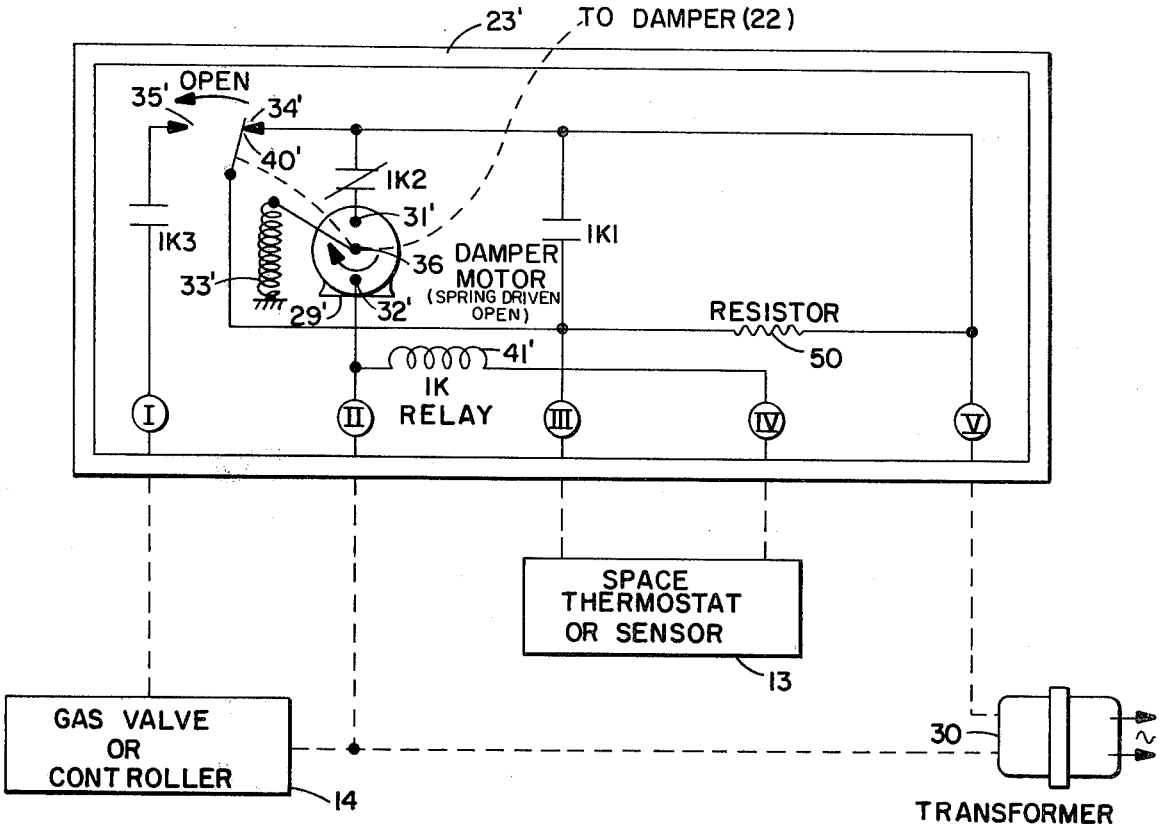
FIG. 3 is the preferred embodiment of the furnace stack damper control apparatus of the present invention.

Referring to FIG. 1, a conventional furnace boiler or temperature conditioning apparatus 10 supplies condition medium for heating to a radiator or heat exchanger 11 in a space 12 in which the temperature is being controlled in response to a temperature responsive switch means or thermostat 13. The furnace has a fuel control apparatus or gas valve 14 connected to a fuel source 15 (not shown), to supply fuel for combustion to furnace 10. The products of combustion exhaust from the furnace through an exhaust stack or flue 20 into a chimney 21.

Located in the exhaust stack 20 is a stack damper 22 which is controlled by a stack damper control apparatus 23 connected by circuit 24 to thermostat 13 and by circuit 25 to a transformer or source of power 30 and gas valve 14.

Referring to FIG. 2, one embodiment of the present invention is shown. The furnace stack damper control apparatus 23 has a conventional electric motor 29 which is driven in one direction to close the damper by an energization circuit at terminals 31 and 32. Motor 29 is a spring return motor which is driven in the opposite direction by a spring 33 for driving the damper open. One particular motor is sold by Honeywell Inc. as the M436A Damper Motor shown in an Instruction Sheet Form 60-2119-3, Rev. 10–75(0.025).

Motor 29 has an end switch apparatus 34 having normally open circuit contacts or switch 35 and normally closed circuit contacts or switch 40 of a conventional type as contained in an M436A Damper Motor. A conventional relay 1K has an energization winding 41 and normally closed contacts or switch 1K1 and two normally open set of contacts or switches 1K2 and 1K3.

When the stack damper control apparatus 23 is connected to a conventional space thermostat 13 such as a T87F, T8100A or T8200A Thermostat sold by Honeywell Inc. and a conventional gas valve 14 such as a V800 Combination Gas Control, also sold by Honeywell Inc., and powered by the output of a transformer 30, the circuit can be traced to provide the following operation. When thermostat 13 is closed, relay 1K is energized by source of power 30 by energization winding 41 through normally closed end switch 40. The energization of relay 1K opens the contacts 1K1 to de-energize damper motor 29 which is normally energized to the closed position by the circuit from the power source through contacts 1K1. Contact 1K3 is a holding circuit to provide power to 1K after end switch circuit contact 40 is broken. The damper motor moves to an open position under the power of return spring 33. At the same time, end switch 34 is operated to open the normally closed circuit 40 and close the normally open circuit 35 to bring about energization of gas valve 14 from source of power 30 through the thermostat 13, the normally open end switch contacts 35, and back to the source of power through the now closed 1K2 contacts.

Description of the Preferred Embodiment

Referring to FIG. 3, furnace stack damper control apparatus 23' has a conventional electric motor 29', similar to motor 30, with an energization circuit between terminals 31' and 32' and an output shaft 36 adapted to be connected to a stack damper 22 as shown in FIG. 1. Relay 1K has an energization winding 41' and normally closed contacts or switch 1K2 and two normally open contacts or switches 1K1 and 1K3 operated thereby. Motor 29' is a spring return motor having a return spring 33' connected to return output shaft 36 to a damper open position when the motor is de-energized. Motor 29' has an end switch 34' with a normally open switch 35' and a normally closed switch 40'. End switch 34' operates near the last 10° of operation of output shaft 36.

Operation of the Preferred Embodiment of the Invention

When the stack damper control apparatus 23 is connected as shown in FIG. 3 to gas valve 14, space thermostat 13 and source of power 30 at the connection terminals I, II, III, IV and V, the following operation takes place. Upon a call for heat by space thermostat 13, relay 1K is energized by connecting source of power transformer 30 to the energization winding 41' in the following manner. From one side of the transformer 30 to terminal II, energization winding 41', to IV, thermostat 13, terminal III, normally closed contact 40' of the end switch, and back to the transformer through terminal V. Upon the energization of relay 1K, relay contacts 1K2 open and the normally energized motor 29 which is energized to maintain damper 22 closed is de-energized and the damper motor returns under the power of the spring return 33' to a damper open position. At the same time, end switch 40' is moved to close normally open contacts 35' and open the normally closed contacts 34'. Gas valve 14 is energized through the circuit from the transformer through gas valve 14, terminal I, the now closed relay contact 1K3, the now closed end switch contact 35', the now closed relay contact 1K1, terminal V, and back to the source of power 30. Using contact 1K1 for the energization of valve 14 allows for only the relay energization current through winding 41' as the thermostat load.

A resistor 50 of approximately 1000 ohms is placed between terminals III and V to maintain a low level current through the space thermostat 13 and relay 1K at all times, regardless of the operation of the switches, as certain space thermostats have memories which must be continuously energized. If the thermostat circuit is broken even for a short time, the memory can be lost. Such is the case with thermostats such as the T8100A and/or T8200A Microelectronic Chronotherm Fuel Saver Thermostats manufactured by the present assignee of this invention, Honeywell Inc.

The embodiment of the invention in which an exclusive property or right is claimed are defined as follows:

1. A stack damper control apparatus adapted to be connected to a damper in the exhaust stack of a fuel burning temperature conditioning apparatus and connected to a space temperature responsive switch means and a source of power for energizing fuel control means comprising, motor means having a first energization circuit and an output connected to said damper to drive said damper to a closed position upon energization of said motor means, a spring return means connected to said motor means for driving said output to drive said damper to an open position, relay means having second energization circuit and two normally open switch means and a normally closed switch means controlled thereby, switch means connected to said output of said motor means having two circuits, a first of said two circuits of said switch means being closed when said motor is in an energized position and the damper is closed, and a second of said two circuits of said switch means being closed when said motor is in a de-energized position and said damper is open, first circuit means including said first circuit of said switch means adapted to connect said second energization circuit of said relay means in series with the space temperature responsive switch means and the source of power whereby upon a call for heat by the responsive means, said relay means is energized, second circuit means comprising said normally closed switch means adapted to connect said first energization circuit of said motor means to the source of power whereby upon said relay means being energized upon a call for heat by the responsive means, said motor means is de-energized and said spring return drives said output and said damper to an open position, third circuit means comprising a first and a second of said normally open switch means and said second circuit of said switch means adapted to connect the fuel control means to the source of power for operating the temperature conditioning apparatus, and fourth circuit means connecting said second of said normally open switch means in parallel with said first circuit of said switch means to maintain said relay means energized while the damper is open.

2. The invention of claim 1 wherein said switch means connected to said output of said motor is a snap acting switch which operates in the position of said output near the open position of the damper.

3. The invention of claim 1 wherein said motor means is an AC motor receiving power from an AC source of power.

4. The invention of claim 1 wherein said stack damper control apparatus has five circuit connection terminals, wherein a first is adapted to be connected to fuel control means, a second is adapted to be connected to one side of a source of power and to the fuel control means, a third and a fourth are adapted to be connected to a space temperature responsive switch means, and a fifth is adapted to be connected to the other side of the source of power.

* * * * *